US009050568B2

(12) United States Patent
Colding-Kristensen et al.

(10) Patent No.: US 9,050,568 B2
(45) Date of Patent: Jun. 9, 2015

(54) HYBRID MIXER

(75) Inventors: Holger Colding-Kristensen, Hals (DE); Hans Henrik Mortensen, Norresundby (DE); Søren Kristian Andersen, Aalborg SO (DE)

(73) Assignee: Tetra Laval Holdings & Finance S.A., Pully (CH)

( * ) Notice: Subject to any disclaimer, the term of this patent is extended or adjusted under 35 U.S.C. 154(b) by 1079 days.

(21) Appl. No.: 12/735,455

(22) PCT Filed: Jan. 5, 2009

(86) PCT No.: PCT/DK2009/050001

§ 371 (c)(1),
(2), (4) Date: Sep. 13, 2010

(87) PCT Pub. No.: WO2009/089837

PCT Pub. Date: Jul. 23, 2009

(65) Prior Publication Data

US 2011/0013475 A1 Jan. 20, 2011

(30) Foreign Application Priority Data

Jan. 16, 2008 (DK) ..... 2008 00060

(51) Int. Cl.

| | |
|---|---|
| ***B01F 5/10*** | (2006.01) |
| ***B01F 3/12*** | (2006.01) |
| ***B01F 7/16*** | (2006.01) |

(52) U.S. Cl.

CPC ..... *B01F 3/1221* (2013.01); *B01F 5/104* (2013.01); *B01F 7/1635* (2013.01)

(58) Field of Classification Search

CPC ..... B01F 5/104
USPC ..... 366/136, 137, 192–196
See application file for complete search history.

(56) References Cited

U.S. PATENT DOCUMENTS

| | | | | | |
|---|---|---|---|---|---|
| 145,027 | A | * | 11/1873 | Stoll | 366/192 |
| 612,181 | A | * | 10/1898 | Spurrier | 202/118 |
| 1,565,661 | A | * | 12/1925 | Lomax | 127/22 |
| 2,608,392 | A | * | 8/1952 | Bowman | 366/137 |
| 3,583,682 | A | | 6/1971 | Berents | |
| 5,439,288 | A | * | 8/1995 | Hoffman et al. | 366/137 |
| 6,039,470 | A | * | 3/2000 | Conwell | 366/137 |

(Continued)

FOREIGN PATENT DOCUMENTS

| | | |
|---|---|---|
| DE | 3703823 | 8/1988 |
| DE | 3703823 A1 | 8/1988 |

(Continued)

*Primary Examiner* — David Sorkin
(74) *Attorney, Agent, or Firm* — Finnegan, Henderson, Farabow, Garrett & Dunner, L.L.P.

(57) ABSTRACT

A mixer (1) for processing one or more fluid media (2) and optionally one or more solid media (3). The mixer (1) consists of a tank (4) with one or more filling openings (5) and a discharge opening (6) at the bottom of the tank (4), and a mixer unit (8) provided at the bottom of the tank. The mixer unit (8) includes a rotor (9), an inlet (10) and an outlet (11). The mixer unit (8) also includes a valve arrangement (12) with a valve body (13), an inlet (14) communicating with the outlet of the mixer unit (8), a first outlet (14) communicating with the discharge opening (6) of the tank and a second outlet (15) communicating with an inlet in the tank (4). A connection (20) may be provided between the first outlet (15) of the valve arrangement and at least one of the filling openings of the tank.

7 Claims, 17 Drawing Sheets

(56) References Cited

U.S. PATENT DOCUMENTS

| | | | | |
|---|---|---|---|---|
| 6,129,450 | A * | 10/2000 | Braun | 366/83 |
| 2006/0114744 | A1 * | 6/2006 | White et al. | 366/101 |

FOREIGN PATENT DOCUMENTS

| | | | |
|---|---|---|---|
| DE | 19537303 | | 3/1997 |
| DE | 19537303 | A1 | 3/1997 |
| EP | 0036067 | | 9/1981 |
| EP | 0036067 | A2 | 9/1981 |
| EP | 0204294 | A2 | 12/1986 |
| EP | 0760254 | A1 | 3/1997 |
| EP | 0896833 | | 2/1999 |
| EP | 0896833 | A1 | 2/1999 |
| WO | WO 03/002241 | A1 | 1/2003 |
| WO | 2006/131800 | | 12/2006 |

* cited by examiner

HYBRID MIXER

This application is a US national stage application of PCT/DK2009/050001, filed on Jan. 5, 2009, which claims priority to Danish Application No. PA 2008 00060, filed on Jan. 16, 2008.

FIELD OF THE INVENTION

The present invention concerns a mixer for processing one or more fluid media and optionally one or more solid media, the mixer consisting of a tank with one or more filling openings and a discharge opening at the bottom of the tank, and a mixer unit provided at the bottom of the tank with a rotor, an inlet and an outlet and a valve arrangement with a valve body, an inlet and a first and a second outlet, that the inlet communicates with the outlet of the mixer unit, wherein the first outlet communicates with the discharge opening of the tank, and that the second outlet communicates with an inlet in the tank.

BACKGROUND OF THE INVENTION

In the food industry and the pharmaceutical industry, mixers are widely used for mixing primarily fluid media which may be added one or more solid media. The applied mixers are typically using two different main principles, batch mixing and inline mixing.

A batch mixer consists of a tank in which is provided units for mixing the media in the tank. The medium will circulate in the tank. When the medium in the tank has reached the wanted condition, the tank is to be emptied. In some cases, this occurs by tilting the whole tank and the mixed medium is poured out of the tank from the top and over into a suitable container. In other cases, the tank is provided with a discharge opening at the bottom such that tilting of the tank is avoided. This is particularly advantageous in connection with large tanks. By highly viscous media, emptying of the tank will occur very slowly if only using the action of gravity on the medium. Therefore, it is necessary to arrange special means such that a more rapid emptying of the tank is achieved. The tank top may e.g. be provided with a pressure-tight lid and a compressed air supply in order to force the medium out, but this requires that the compressed air supply is provided with a device for cleaning the compressed air if the mixer is used for foodstuffs, medicine or other media which do not stand up to contamination with uncleaned air. Instead, a pump may be connected to the discharge opening for sucking out the medium. This pump has to be self-priming or be a positive pump disposed below the outlet level of the tank.

Batch mixing will typically take place in connection with mixing of media that are added much dry matter, media that are highly viscous, media that are sticky, and media that are to be mixed for a short time, e.g. emulsions.

An inline mixer also consists of a tank in which there may be provided units for mixing the media in the tank. The bottom of the tank is provided with a discharge opening which normally is shut off. The discharge opening is connected with a pipe between the tank and the shutoff of the discharge opening which discharges into the tank through a filling opening at the upper part of the tank. The medium thus circulates outside the tank. A mixer unit placed in the tank or a pump outside the tank may deliver the required pumping action for maintaining circulation of the medium. The tank is emptied when the medium is sufficiently mixed. This is effected in that the connection between the discharge opening and the filling opening of the tank is shut off simultaneously with the shutoff on the discharge opening of the tank is removed. The mixer unit or the pump outside the tank may be used for quicker emptying of the tank.

Inline mixing will typically find application in connection with mixing of media that are added a little or no dry matter, media with viscosity or media that are to be mixed for a long time.

In connection with certain processes, it is desirable to be able to perform a combination of batch mixing and inline mixing. Such a mixer is known from WO 2006/131800 which discloses a mixer with a mixer unit at the bottom of the tank. Some of the medium circulates within the tank while at the same time another part of the medium is conducted out of a discharge opening and through a pipe which is connected to a filling opening in the tank. This causes a mixing of the medium. The ratio between the part of the medium circulating inside the tank and the part of the medium circulating through the pipe outside the tank is fixed. The ratio is determined on the background of the properties of the media that are desired to be mixed, and the ratio determines the dimension of the mixer. The drawback is that even in the best case and if possible at all, this is associated with a comprehensive rebuilding of the mixer when wanting to process other media. This type of mixer cannot operate exclusively as batch mixer or exclusively as inline mixer, but will only function as a hybrid between the two mixer types.

In various process industries in which mixers are used there is a desire to enable rearranging the process facilities such that different media can be processed. It will additionally be advantageous to perform the switching between batch and inline mixing during the same working process. This will give greater flexibility with regard to the media which can be processed and thereby with regard to which products that may be produced. Also, it will be advantageous to combine the two processing principles in one and the same machine for process industries using both inline and batch mixers, as it becomes possible to lower the capacity costs by minimising the number of mixers.

OBJECT OF THE INVENTION

It is the purpose of the invention to indicate a mixer for mixing one or more fluid media and optionally one or more solid media, where the mixing of the media can be performed exclusively by mixing in the tank by batch mixing, and where the design of the mixer enables rapid rearrangement of the mixer to discharge the medium through the discharge opening of the tank such that the pumping action of the mixer unit can be utilised during emptying of the tank and/or the mixer can function as an inline mixer.

DESCRIPTION OF THE INVENTION

According to the present invention, this is achieved by a mixer of the type specified in the introduction and which is peculiar in that the rotor of the mixer unit includes a number of annularly distributed impeller blades for establishing a medium flow through the mixer unit and that the mixer unit includes a perforated cylindric ring provided with passages in the form of holes and/or slots.

The mixer unit will preferably be disposed at a central position in a cylindric tank with the rotary axis of the rotor coaxial with the centre axis of the tank.

In a particularly advantageous embodiment, the rotor will be designed as a circular disc with a number of impeller blades disposed at the top side of the disc and interacting with adjacent apertures in the disc, whereby the medium is pressed through the apertures under the action of the rotating impeller blades.

At the bottom side of the disc there is also provided a number of impeller blades.

The impeller blades at the top side of the rotor are designed such that they create an axial medium flow while the impeller blades at the bottom side are designed such that they create a radial medium flow. The medium will hereby be sucked into the mixer unit from the top of it and in the centre of the tank in order to be conducted out of the mixer unit at the bottom of it and with a flow running radially away from the centre of the tank.

Alternatively, the rotor can be a pump wheel which is designed in a way known from i.a. centrifugal pumps, where the impeller blades have a curving shape, where blades are only provided at one side of the disc and where the disc is not provided with apertures.

The holes and/or slots in the perforated ring are chosen with a dimension which will provide for the desired degree of homogenisation. When the medium is pressed through the perforated ring, it will be disintegrated, partly due to the size of the holes/slots and partly because the impeller blades of the rotor crushes larger particles against the perforated ring, cutting the particles in pieces while they pass the perforated ring.

When the valve arrangement is in a first extreme position, the rotor will produce a flow in the tank, where the medium is conducted out of the mixer unit at the bottom of the tank and flows from the centre and along the bottom of the tank towards the sides of the latter. The medium will flow along the sides up towards the top of the tank where it flows inwards against the centre in order to be sucked into the top of the mixer unit.

When the valve arrangement is in a second extreme position, the medium will be conducted out of the discharge opening at the bottom of the tank. In the embodiment where there is a connection between the discharge opening of the tank and a filling opening at the top of the tank, the medium will be conducted back to the tank where it flows in towards the centre in order to be sucked into the top of the mixer unit. If there is no connection to the filling opening of the tank, the medium will be conducted out of the tank, which is emptied thereby.

The mixer unit includes a perforated cylindric ring provided with passages in the form of holes and/or slots for processing certain products where e.g. the dry matter contains large particles of which are desired a better distribution in the fluid medium, it is required to enable disintegration of these particle by a so-called homogenising.

The perforated ring will typically be provided between the outlet of the mixer unit and the inlet of the valve arrangement. The perforated ring is designed such that it encloses the outlet from the mixer unit such that all the medium has to pass the perforated ring. The disposition of the perforated ring between the outlet of the mixer unit and the inlet of the valve arrangement means that the liquid will be homogenised, irrespectively whether the mixer is operating as a batch mixer or as an inline mixer.

By providing the mixer with a valve arrangement of the above described type, it becomes possible to either lead the medium directly back into the tank after it having passed the mixer unit, or to lead the medium out through the discharge opening of the tank. The medium may then, depending the form of the external connections, be led back to the tank or out of the tank for possible further processing in a process facility, or to a larger buffer tank. In the first case, the mixer operates exclusively as a batch mixer, and in the second case it is possible either to empty the tank or to use the mixer as an inline mixer. In the latter case, it is possible to process an amount which is larger than the volume of the mixer.

Since the pumping action of the mixer can be utilised for emptying the tank, it is not necessary to connect a pump or a compressed air supply in order to empty the tank as by the prior art batch mixers.

If expedient, it is still possible to connect a compressed air connection or a pump for increasing the rate at which the tank is emptied. The mixer unit can be used for priming the pump such that it is not necessary to choose a self-priming pump type, which is desirable as these are often more complicated and thereby entail a larger cost than pumps which are not self-priming.

In connection with processing products that are to be sterile, or where there are special requirements to hygiene, it is advantageous to limit the number of switches between different process machines. A mixer provided with a valve arrangement according to the invention is particularly advantageous in this respect since it is possible for it to function both as batch mixer and as inline mixer. Emptying the tank may occur sterilely as the pumping action of the mixer unit can be utilised without having to connect a compressed air supply as a supplement. Hereby is avoided the risk of contamination coming from the compressed air supply.

Furthermore, at mixer according to the invention will enable a reduction of the capital costs as the same mixer may be operated as batch mixer as well as inline mixer.

According to a further embodiment, the mixer according to the invention is peculiar in that the inlet of the valve arrangement is identical with the outlet of the mixer unit, that the first outlet of the valve arrangement is identical with the discharge opening of the tank, and that the second outlet of the valve arrangement discharges directly into the tank.

This is particularly advantageous as the components that otherwise should establish the connection between the various outlets and inlets, respectively, are hereby eliminated. The outlet of the mixer unit will typically be a cylindric opening enclosing the rotor. The discharge opening of the tank will typically be a circular opening at the bottom of the tank which is provided with a branch that may be connected to a pipe which is connected to a filling opening in the upper part of the tank or a process facility performing further processing of the product. The walls of the valve arrangement can be formed by a combination of the walls and bottom of the tank in conjunction with the valve body. The shape of the outlet of the valve arrangement will thereby be determined by the said elements in conjunction.

According to a further embodiment, the mixer according to the invention is peculiar by the valve body being disposed coaxially about the rotary axis of the rotor.

This is advantageous as the elements may be established in the valve unit as rotary bodies/rotary surfaces in a technically simple way.

According to a further embodiment, the mixer according to the invention is peculiar in that the valve body has a first extreme position where the valve body shuts off the first outlet, and a second extreme position where the valve body shuts off the second outlet, and that the valve body is connected with a retaining means such that it may be retained at an arbitrary position between the two extreme positions, where the valve body partially shuts of the first outlet and the second outlet, respectively.

In the first extreme position of the valve body where it shuts off the first outlet communicating with or being identical with the discharge opening of the tank, the medium will circulate in the tank and thereby become mixed with the added media.

When the media have achieved the desired mixing condition, the valve body may be moved to its second extreme position whereby the outlet to the tank is shut off and the medium is conducted out of the tank through its discharge opening.

The pumping action of the rotor is hereby utilised for emptying the tank. If the valve body is retained at a position between the two extreme positions, a part of the medium will circulate in the tank while another part is led out of the tank. The ratio between the part of the medium circulating in the tank and the part led out of the task can be arbitrarily varied between 0/100 and 100/0.

According to a further embodiment, the mixer according to the invention is peculiar in that the displacement of the valve body is selected among a displacement which is axial, radial, rotational, or a combination of a radial, rotational and axial displacement in relation the rotary axis of the rotor.

Different ways of moving the valve body between its extreme positions can be selected, depending on what is practically feasible for the individual application. A particularly advantageous embodiment uses axial translation of the valve body. Linear actuators with stays into the tank are applied where they are connected to the valve body.

Radial translation of the valve body will find application, for example, in cases where it is necessary to dispose the actuators horizontally due to limited space conditions under the tank.

Rotary displacement can be used where it is desired to drive the valve body with a rotating actuator as e.g. an electric motor.

The combination of the above directions of movement is found if providing an annular valve body with a screw thread that interacts with a threaded counterpart in the tank or mixer unit. This may be advantageous where great precision in the movement as well as retention of the valve body is desired.

According to a further embodiment, the mixer according to the invention is peculiar in that a connection is provided between the first outlet of the valve arrangement and at least one of the filling openings of the tank.

This is a particularly advantageous embodiment as the mixer hereby may operate as an inline mixer. This makes it possible to process media with low viscosity in one and the same mixer also used for highly viscous media such that the mixer can be used both for batch mixing and for inline mixing. The special valve arrangement also enables rapid switching between the two types of mixers.

Besides, rearrangement of the mixer can take place during operation such that it e.g. becomes possible to process a medium having low viscosity at the beginning and which is later provided high viscosity in the same tank, without interrupting the operation.

The mixer will initially operate as inline mixer with the valve body in its second extreme position. The medium will circulate through the connection provided between the first outlet of the valve arrangement and at least one of the filling openings of the tank. The discharge opening situated after the said connection will be shut off. When the medium reaches a condition where batch mixing is more suitable, the valve body is moved to its first extreme position, and the mixer will start to operate as a batch mixer. For example, by mixing fruit juice with thickener agent into jam or jelly.

According to a further embodiment, the mixer according to the invention is peculiar in that the connection between the first outlet of the valve arrangement and at least one of the filling openings of the tank is optionally provided with a valve.

This provides the option of shutting off the connection between the discharge and filling openings of the tank. If at the same time the valve arrangement in the tank is set at a position where the connection to the discharge opening is completely open, the medium will flow out of the tank without recirculating through the previously mentioned connection to the tank, which is emptied thereby.

The valve arrangement may also be placed at a position between the two extreme positions such that the connection to the discharge opening and the inlet to the tank are both partially open. The mixer will continue to mix the medium simultaneously with being emptied which is advantageous in connection with media that become solid if the mixing ceases. The mixer will partly function as batch mixer while the tank is emptied.

In an alternative embodiment, the valve in the connection between the discharge and filling openings of the tank is chosen such that it may be regulated steplessly from a position where it is completely closed to a position where it is completely open.

If at the same time the valve arrangement in the tank is set in a position where the connection to the discharge opening is completely open, the medium will flow out of the tank simultaneously with a part is recirculated through the connection between the discharge and filling openings of the tank, while at the same time the tank is emptied. The mixer will partly function as an inline mixer while the tank is emptied.

According to a further embodiment, the mixer according to the invention is peculiar in that the perforated ring is optionally stationary or connected with a displacing means such that it may be displaced between a first position where it entirely encloses the outlet of the rotor to a second position where it does not enclose the outlet of the rotor, and that the perforated ring may be retained at an arbitrary position between the two positions at which the perforated ring partially encloses the outlet of the rotor.

This is particularly advantageous in connection with processing products where media that are to be homogenous are initially mixed, and where dry matter which is not to be comminuted is later desired added.

The perforated ring is set in its first position such that all medium flows through the perforated ring. The perforated ring will then be moved to its second position so that the medium does not pass the perforated ring, after which the dry matter not to be comminuted is added. Examples of these applications may be the production of ice-cream containing whole berries and the making of soups containing vegetable and meat pieces.

Besides, it may be desirable to be able to set the perforated ring at a position where it only partly covers the outlet of the mixer unit. Hereby is achieved a partial disintegration of the added dry matter. This finds application in connection with making stewed fruit, fruit jelly and jam, where the fruits are added whole and then comminuted in the mixer in that some berries partly pass through the perforated ring and other berries and pieces of berries pass outside the perforated ring.

Use of the mixer is not limited to applications in the food industry and the pharmaceutical industry. The mixer can be used in all industries where one or more fluid media are to be mixed, and which optionally may be added one or more dry media. Of related applications can be mentioned mixing of paint, creams and cosmetics, for example.

The mixer can be termed a hybrid mixer enabling batch as well as inline mixing. Moreover, the embodiment with displaceable perforated ring enables a further mixing function as one may choose to mix with or without comminution and homogenisation of the larger particles. Furthermore, the embodiment with a connection between the discharge and filling openings of the tank and a variable valve in this connection will enable partial inline/partial batch mixing while the tank is emptied.

DESCRIPTION OF THE DRAWING

The invention will be explained in more detail below with reference to the accompanying drawing, where.

DETAILED DESCRIPTION OF THE INVENTION

In the explanation of the Figures, identical or corresponding elements will be provided with the same designations in different Figures. Therefore, no explanation of all details will be given in connection with each single Figure/embodiment.

Figure 1:
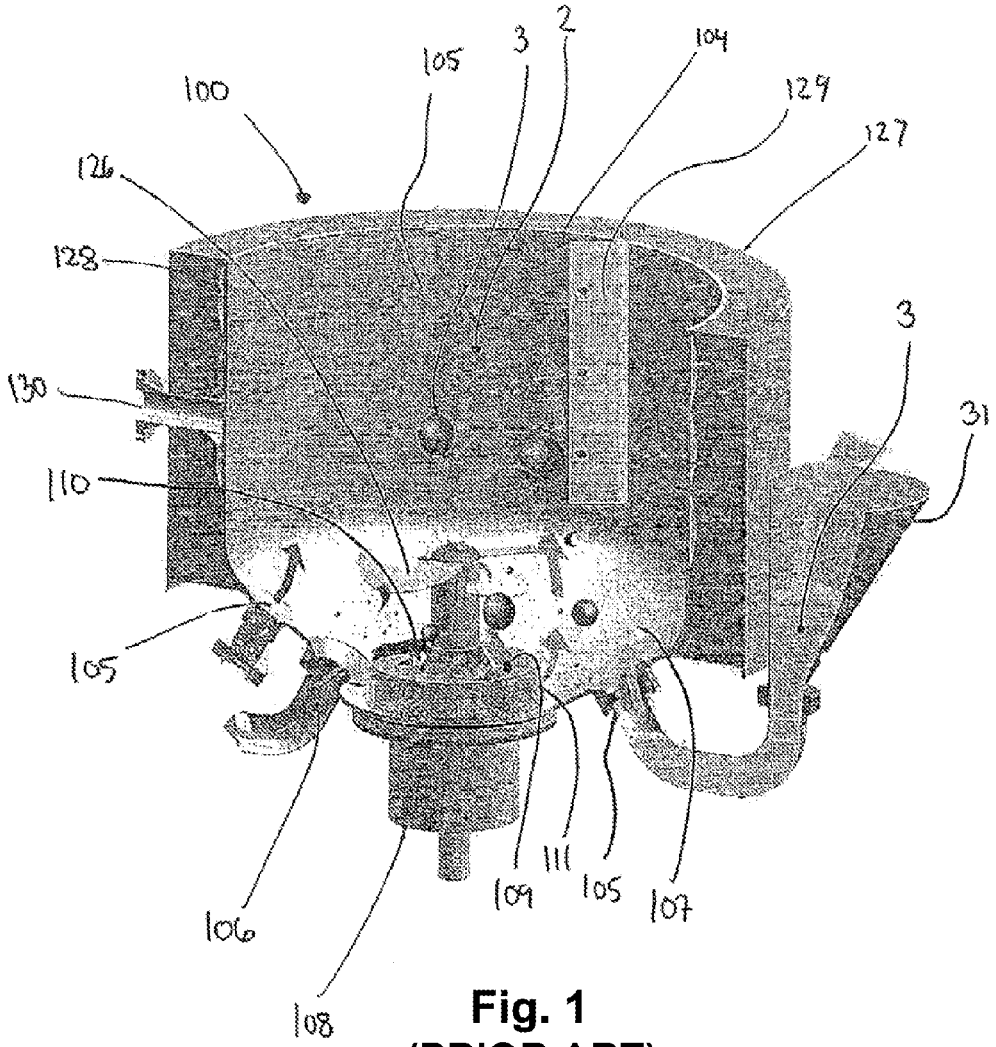
Fig. 1 (PRIOR ART)
FIG. 1 shows an elementary sketch of a prior art mixer.

FIG. 1 shows a prior art batch mixer 100. The mixer 100 consists of a tank 104 with a number of filling openings 105 and a discharge opening 106 at the bottom 107 of the tank 104, a mixer unit 108 with a rotor 109, an inlet 110 and an outlet 111. The shown embodiment of the mixer 100 is provided with a cutter 126 performing an initial comminution of solid media 3 with a particle size that is too large for the particles to flow through the mixer unit 108 immediately. On the sketch is seen how the medium flow is distributed in the tank. At the middle of the tank, the flow will preferably be downwards directed towards the inlet 110 of the mixer unit. The flow is directed upwards close the sides of the tank 104. In cross-section, the flow will be a primarily circular movement. In the shown embodiment, the tank 104 is provided with an insulating jacket 127, a heat exchanger 128 between the jacket 127 and the tank 104, a rotating scraper 129 and a container 131 for solid media 3. The heat exchanger 128 can be used for heating or cooling the medium 2,3 in the tank 104 by adding hot or cold liquid, respectively, through the supply pipe 130. The scraper 129 is used for ensuring that mixing of the medium is effected at the sides of the tank 104, and that no burning of the medium occurs during heating. This is particularly necessary by media with high viscosity. The container 131 for the solid media 3 ensures sufficient supply of this during operation.

Figure 2:
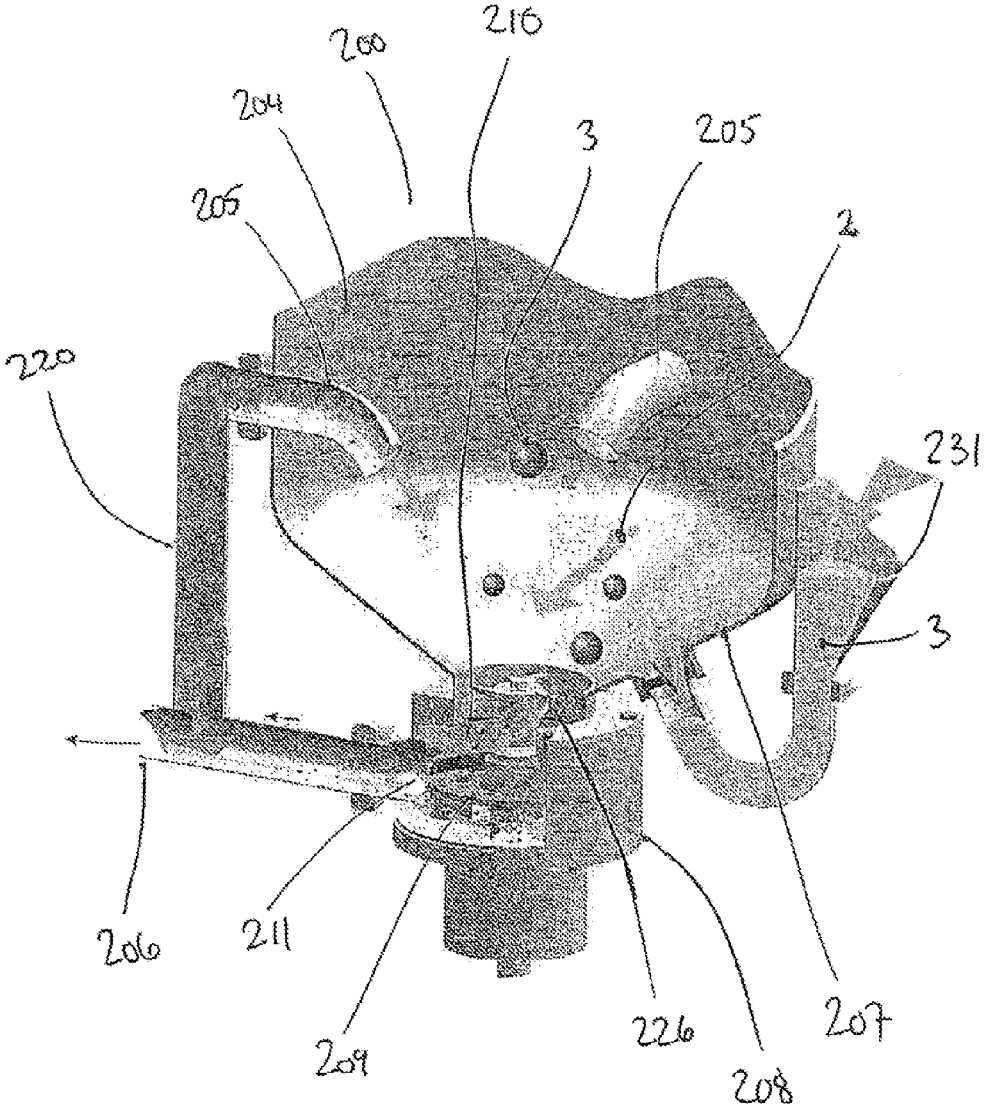
Fig. 2 (PRIOR ART)
FIG. 2 shows an elementary sketch of a prior art inline mixer.

FIG. 2 shows a prior art inline mixer 200. The mixer 200 also consists of a tank 204 with a number of filling openings 205 and a discharge opening 206 at the bottom 207 of the tank 204, a mixer unit 208 with a rotor 209, an inlet 210 and an outlet 211. The shown embodiment of the mixer 200 is provided with a cutter 226 performing an initial comminution of solid media 3 with a particle size that is too large for the particles to flow through the mixer unit 208. On the sketch is seen how the medium flow is distributed in the tank. At the middle of the tank, the flow will preferably be downwards directed towards the inlet 210 of the mixer unit. A part of the medium can be led out of the tank 204 and through a connection 220 back to the tank 204 through one of its filling openings 205, while another part of the medium is conducted out through the discharge opening 206 of the tank. In the shown embodiment, the tank 204 is provided with a container 231 for solid media 3. The container 231 for the solid media 3 ensures sufficient supply of this during operation.

Figure 3:
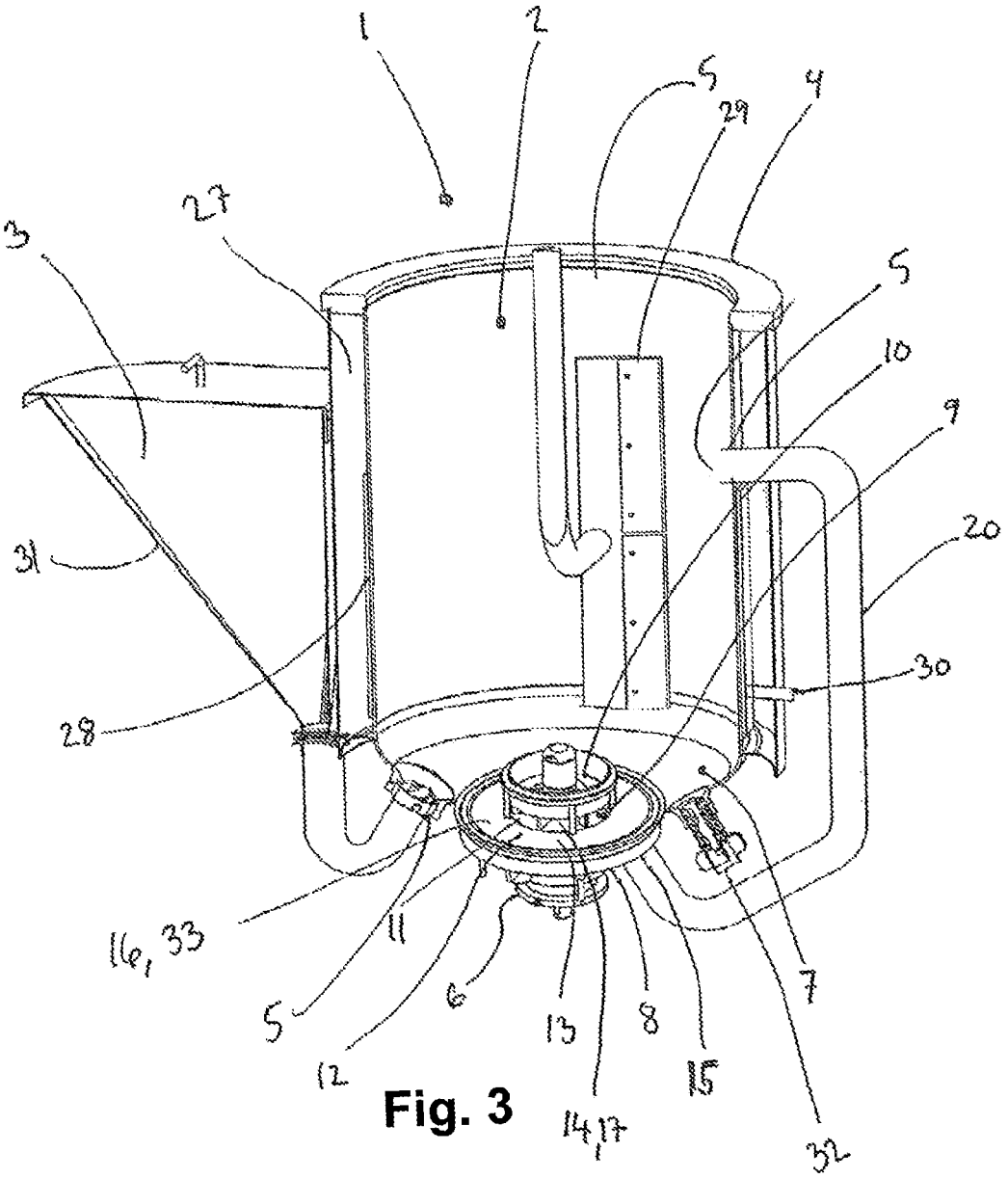
FIG. 3 shows an isometric section of the mixer as batch mixer with tank and mixer unit.
Figure 4:
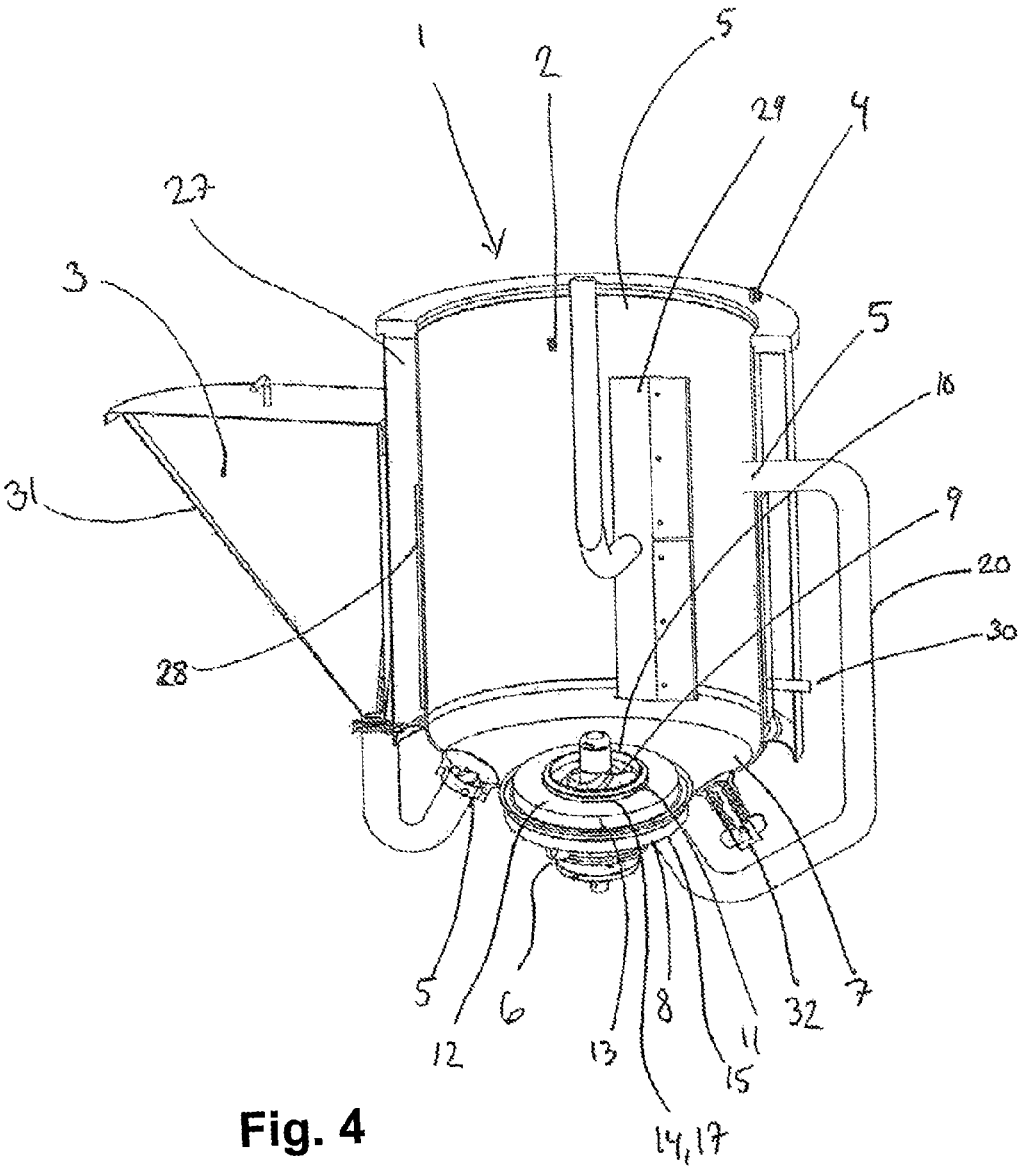
FIG. 4 shows an isometric section of the mixer as inline mixer with tank and mixer unit.

FIGS. 3-4 show an isometric section of the mixer 1 as batch mixer and inline mixer, respectively. The mixer 1 consists of a tank 4 with a number of filling openings 5, a discharge opening 6 at the bottom 7, a mixer unit 8 with a rotor 9, an inlet 10 and an outlet 11. The tank 4 contains one or more fluid media 2.

The mixer unit 8 is shown with an adjacent valve arrangement 12 with a valve body 13. The valve arrangement 12 has an inlet 14 communicating with the outlet 17 of the mixer unit, a first outlet 15 communicating with the discharge opening 6 and a second outlet 16 communicating with an inlet 33 in the tank 4.

The mixer comprises a connection 20 between the first outlet 15 of the valve arrangement and a filling opening 5 in the tank 4.

The shown embodiment of the mixer 1 is shown without a cutter for comminuting particles which are too large to pass the inlet 10 of the mixer unit. A cutter may be fitted if the particles are of such a size requiring use of a such. Moreover, the mixer 1 is provided with a rotating scraper 29, an insulating jacket 27, a heat exchanger 28 with associated supply pipes 30, a container 31 for solid media 3 and a steam connection 32 in the shown embodiment. These components are alternatives and not necessary in the basic form of the mixer.

The mixer unit 8 will typically be powered by an electric motor (not shown) placed outside the tank 4.

Figure 5:
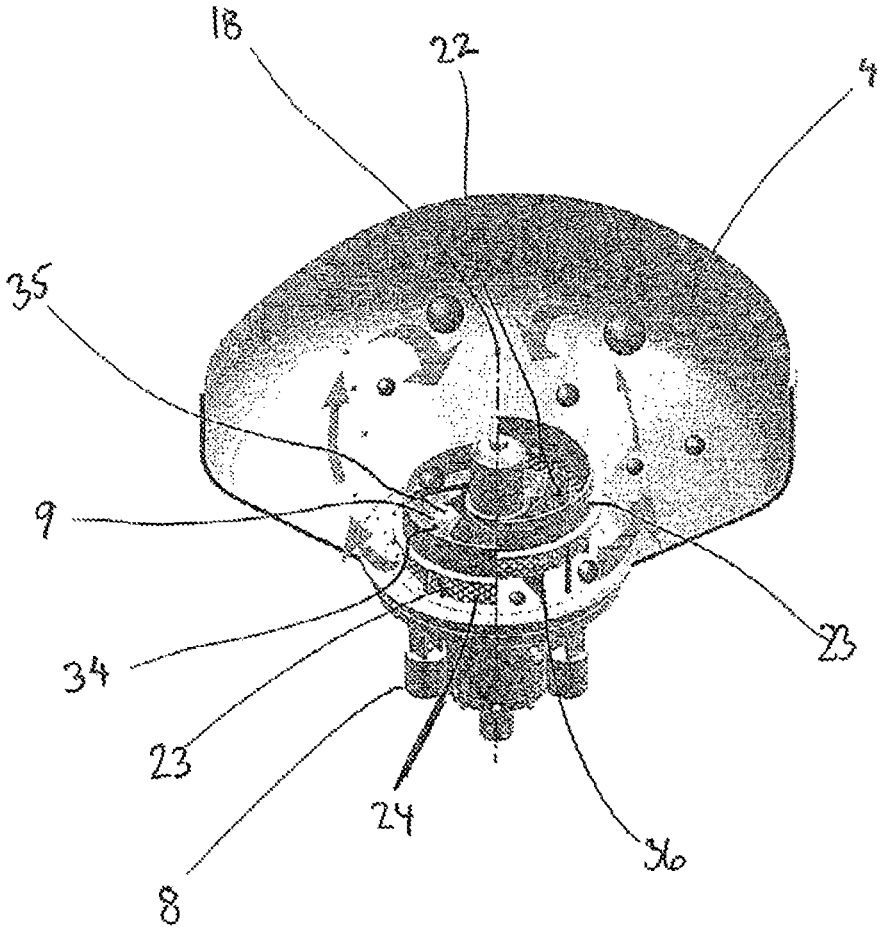
FIG. 5 shows an elementary sketch of the mixer unit with perforated ring.

For the sake of clarity, FIG. 5 shows the mixer unit 8 without valve arrangement 12. The perforated ring 23 is shown in its two extreme positions. In the left half of the illustration, the perforated ring 23 is shown in its first extreme position. In the right half of the illustration, the perforated ring 23 is shown in its second extreme position. The perforated ring 23 is provided with a number of passages 24 which have a size adapted to the desired degree of homogenisation of the medium. The figure illustrates the effect of the perforated ring 23. At left, the large particles are disintegrated during passage of the passages 24 in the perforated ring 23. At right, the large particles pass through the mixer unit 8 without disintegrating because they do not pass the perforated ring 23.

Besides, FIG. 5 illustrates the circular flow in the tank 4. The rotor 9 of the mixer unit provides the pumping action required for establishing this flow. In the shown embodiment, the rotor 9 is designed as a circular disc 34 with a number of impeller blades 22 at the top side which conduct the medium through a number of apertures 35 in the disc 34 when it rotates. The bottom side of the disc 34 is provided with other impeller blades 36 that conduct the medium in a direction radially away from the rotary axis 18 of the rotor.

Figures 6A, 6B, 6C:
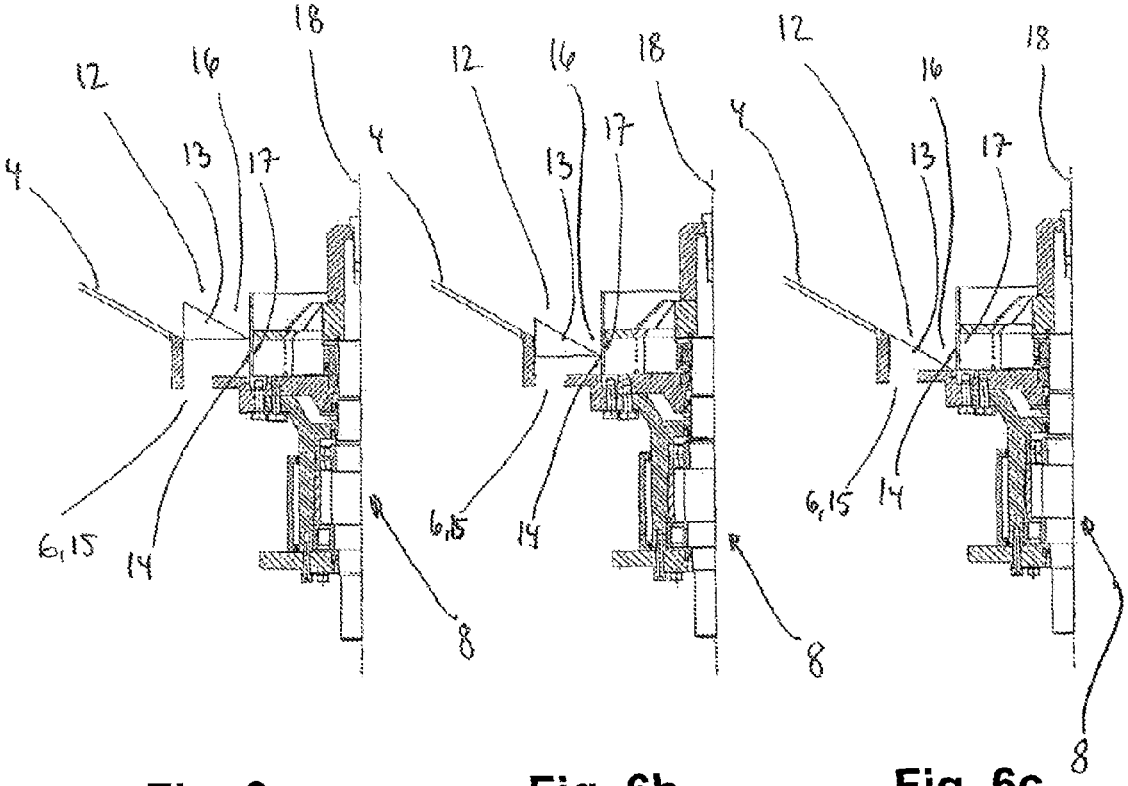
FIGS. 6*a-c* show elementary sketches of the valve arrangement.

FIG. 6*a* shows the principle of inline mixing or emptying the tank 4, FIG. 6*b* shows the principle of hybrid mixing, and FIG. 6*c* shows the principle of batch mixing.

A valve arrangement 12 is provided in connection with the mixing unit 8. The valve arrangement 12 has a valve body 13, an inlet 14 which is identical with the outlet 17 of the mixer unit in the shown embodiment, a first outlet 15 which is identical with the discharge opening 6 in the shown embodiment, and a second outlet 16 which discharges directly into the tank 4 in the shown embodiment.

In the shown embodiment, the valve body 13 moves coaxially with the rotary axis 18 of the rotor.

On FIG. 6*a*, the valve body 13 is shown in its second extreme position where it shuts off the outlet 16 of the valve arrangement in the tank 4. Here, there will be a flow through the first outlet 15 out of the tank 4.

On FIG. 6*b*, the valve body 13 is shown in an intermediate position between the two extreme positions where it partially shuts off the first and second outlets 15, 16, respectively, of the valve. There will be a flow through both the first outlet 15 of the valve and the second outlet 16 of the valve. A part of the medium will remain in the tank 4 and another part of the medium will be led out of the tank 4.

On FIG. 6*c*, the valve body 13 is shown in its first extreme position where it shuts off the first outlet 15 of the valve arrangement. Here, there will be a flow through the second outlet 16 of the valve. The medium will hereby circulate inside the tank 4.

FIGS. 7-15 show the same mixer unit 8 in an alternative embodiment. The Figures show the valve body 13 and the perforated ring 23 in different positions.

The mixer unit 8 consists of a rotor 9 with an inlet 10 and an outlet 11. The rotor 9 rotates about its rotary axis 18 during operation. The rotor 9 is designed as a circular disc 34 with a number of impeller blades 22 at the top side which conduct the medium through a number of apertures 35 in the disc 34 when it rotates. The bottom side of the disc 34 is provided with other impeller blades 36 that conduct the medium in a direction radially away from the rotary axis 18 of the rotor.

A perforated ring 23 enclosing the rotor outlet 11 in one extreme position of it is disposed coaxially with the rotary axis 18 of the rotor. The perforated ring 23 is connected with a displacing means 25 in the form of a number of stays 37 which are passed through the mixer unit 8 to a position outside the tank 4, where they are connected to an actuator (not shown) that may displace the perforated ring 23 between its two extreme positions.

A valve arrangement 12 with a valve body 13 enclosing the perforated ring 23 and the rotor outlet 11 in its one extreme position is disposed coaxially with the rotary axis 18 of the rotor. The valve body 13 is connected to a retaining means 19 in the form of a number of stays 38 which are passed through the mixer unit 8 to a position outside the tank 4, where they are connected to an actuator (not shown) that may displace the valve body 13 between its two extreme positions.

The inlet of the valve arrangement 14 is identical with the outlet 17 of the mixer unit. The first outlet 15 of the valve arrangement is identical with the discharge opening 6 of the tank. The second outlet 16 of the valve arrangement discharges directly into the tank 4.

Figure 7:
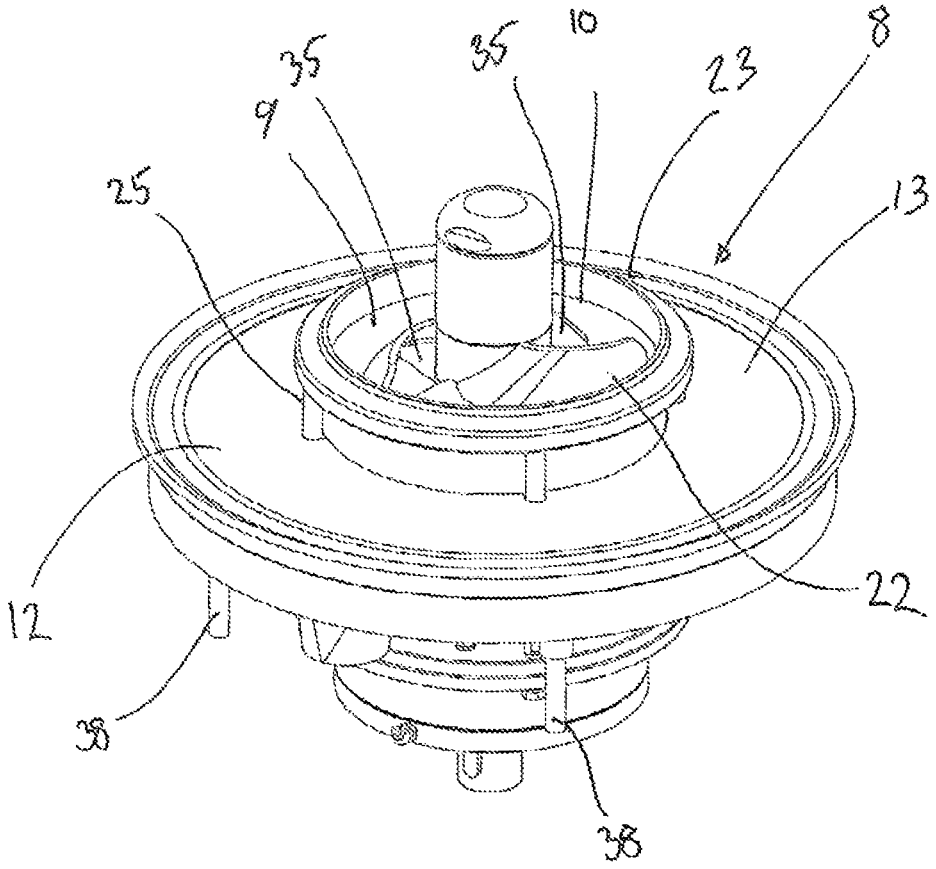
FIG. 7 shows an isometric view of the mixer unit as batch mixer with the perforated ring in its first position.
Figure 8:
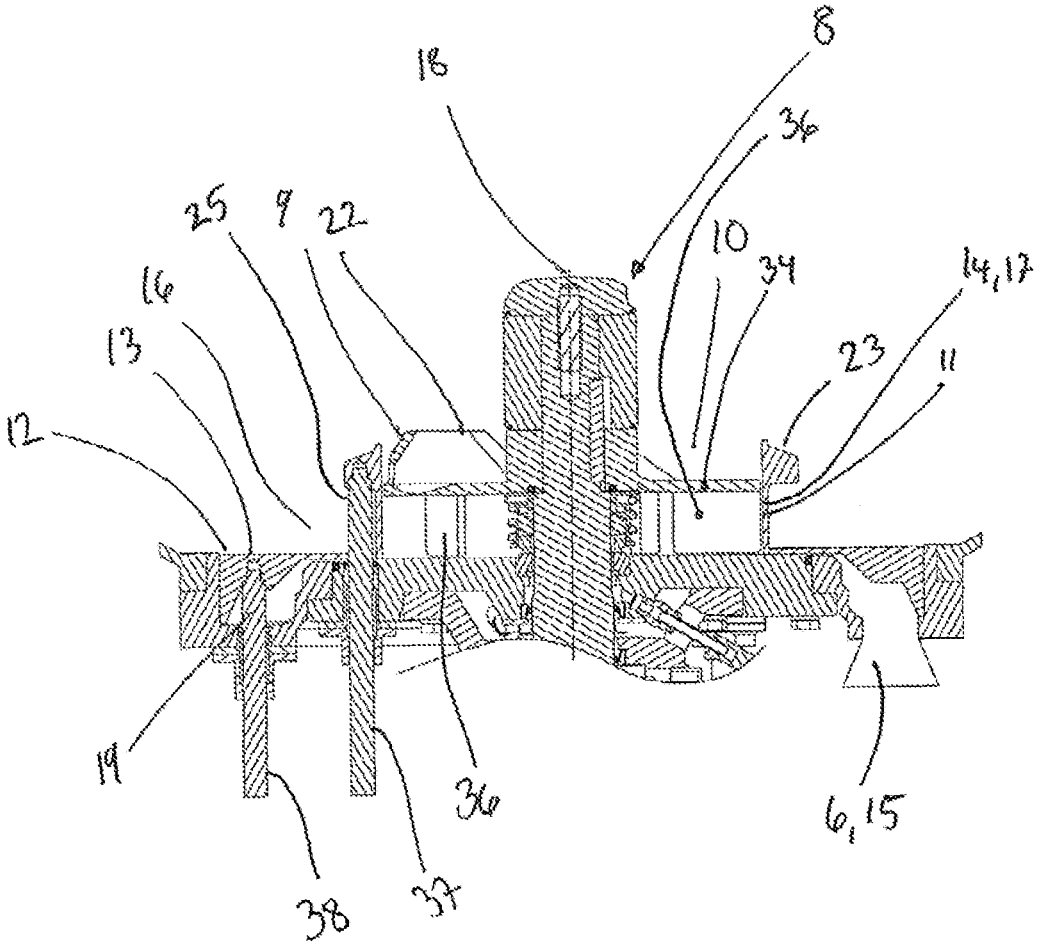
FIG. 8 shows a sectional view of the mixer unit as batch mixer with the perforated ring in its first position.

FIGS. 7-8 show the setting of the mixer unit 8 when it functions as batch mixer with the perforated ring 23 in its first extreme position. The valve body 13 is in its first extreme position such that it shuts off the discharge opening 6 and lets the medium pass directly to the tank 4 in which it is circulated. The medium is homogenised when passing the perforated ring 23.

Figure 9:
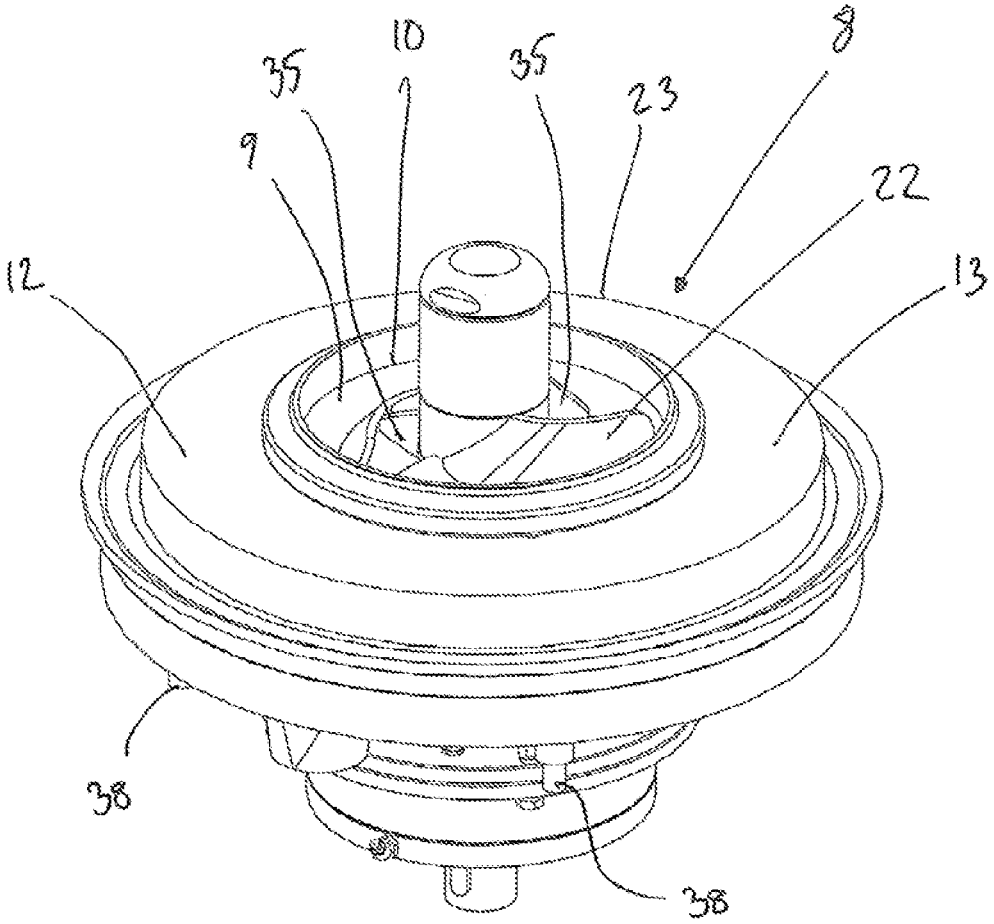
FIG. 9 shows an isometric view of the mixer unit as inline mixer with the perforated ring in its first position.
Figure 10:
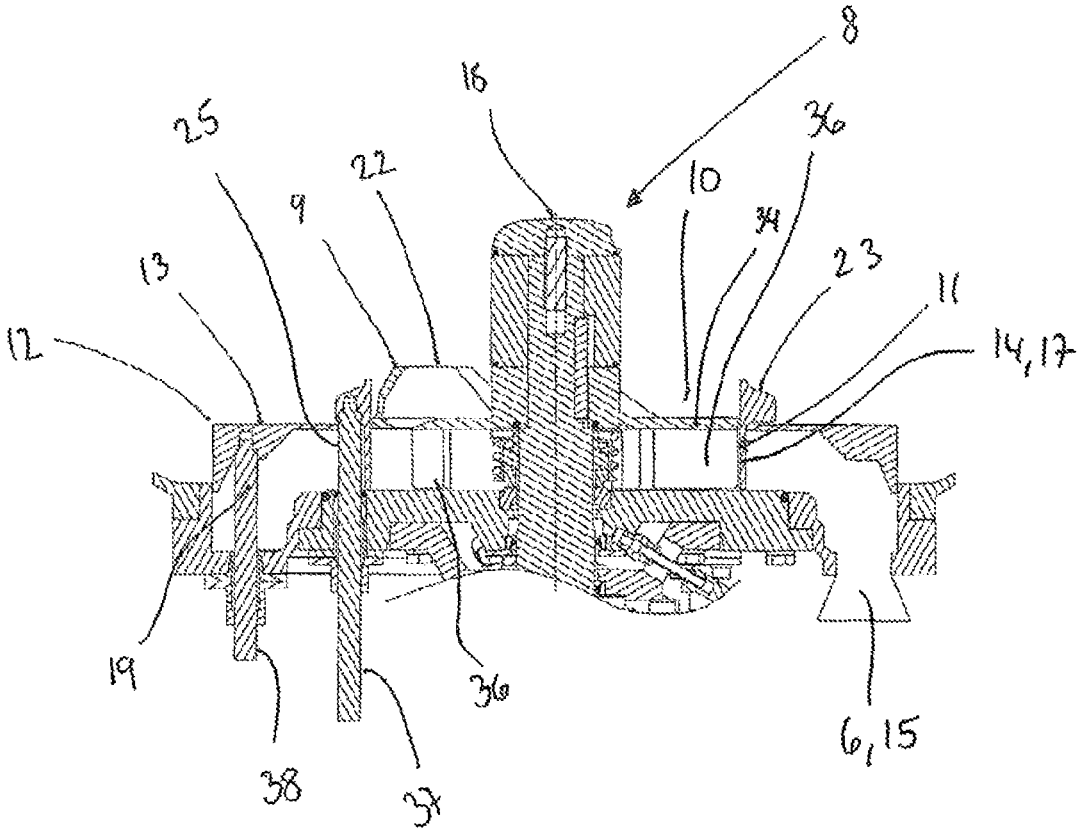
FIG. 10 shows a sectional view of the mixer unit as inline mixer with the perforated ring in its first position.

FIGS. 9-10 show the setting of the mixer unit 8 when it functions as inline mixer or during emptying of the tank 4 with the perforated ring 23 in its first extreme position. The valve body 13 is in its second extreme position so that it shuts off the second outlet 16 of the valve arrangement and lets the medium pass through the discharge opening 6. The medium is homogenised as it passes the perforated ring 23.

Figure 11:
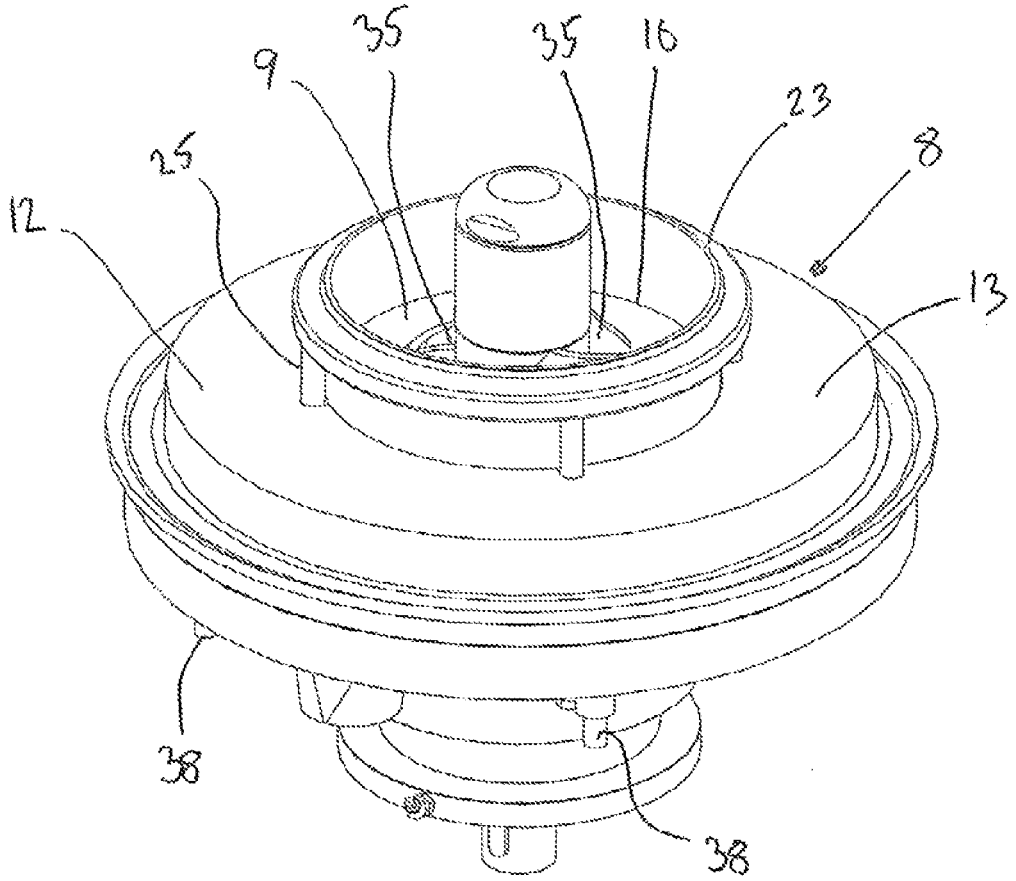
FIG. 11 shows an isometric view of the mixer unit as inline mixer with the perforated ring in its second position.
Figure 12:
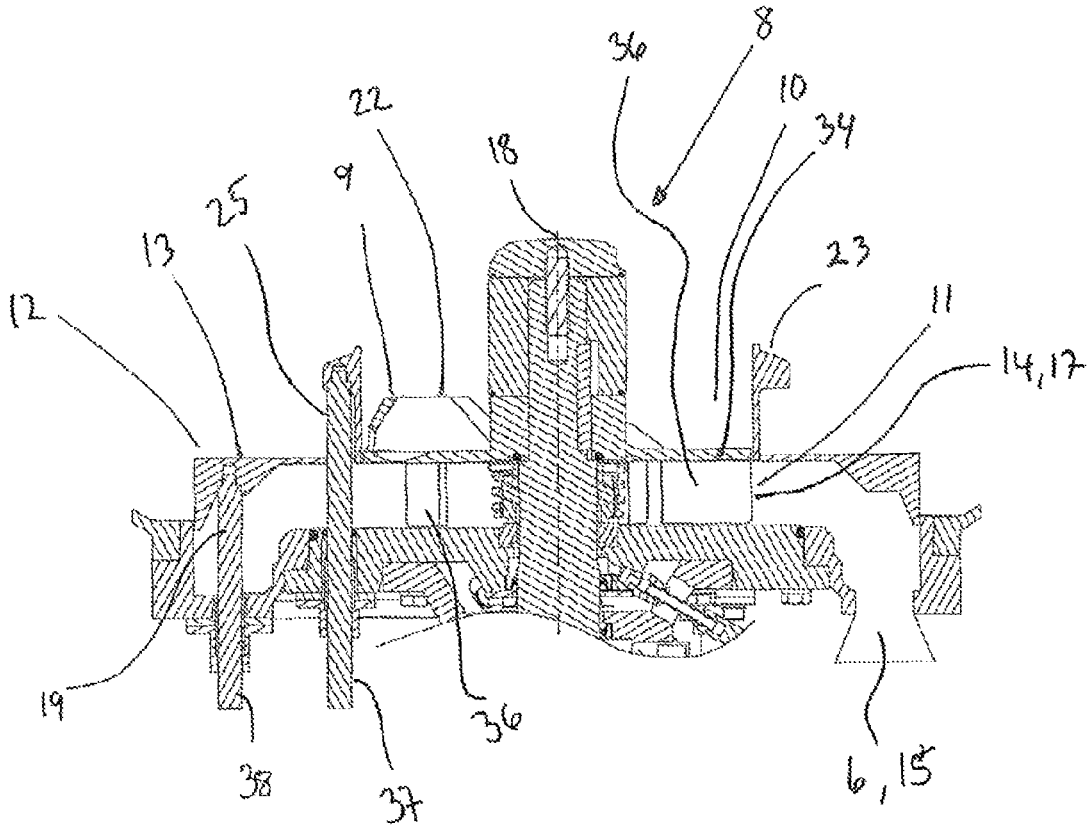
FIG. 12 shows a sectional view of the mixer unit as inline mixer with the perforated ring in its second position.

FIGS. 11-12 show the setting of the mixer unit 8 when it functions as inline mixer or during emptying of the tank 4 with the perforated ring 23 in its second extreme position. The valve body 13 is in its second extreme position so that it shuts off the second outlet 16 of the valve arrangement and lets the medium pass through the discharge opening 6. The medium is not homogenised as it does not pass the perforated ring 23.

Figure 13:
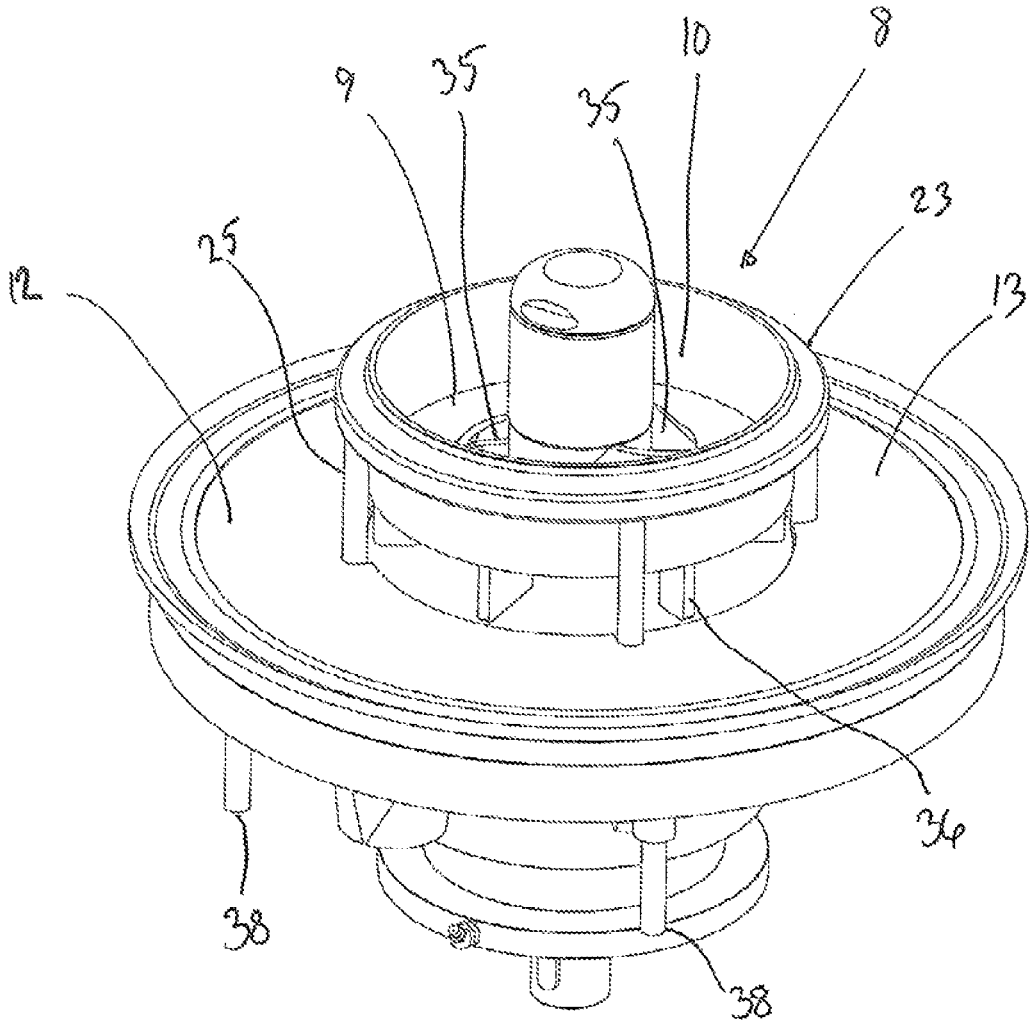
FIG. 13 shows an isometric view of the mixer unit as batch mixer with the perforated ring in its second position.
Figure 14:
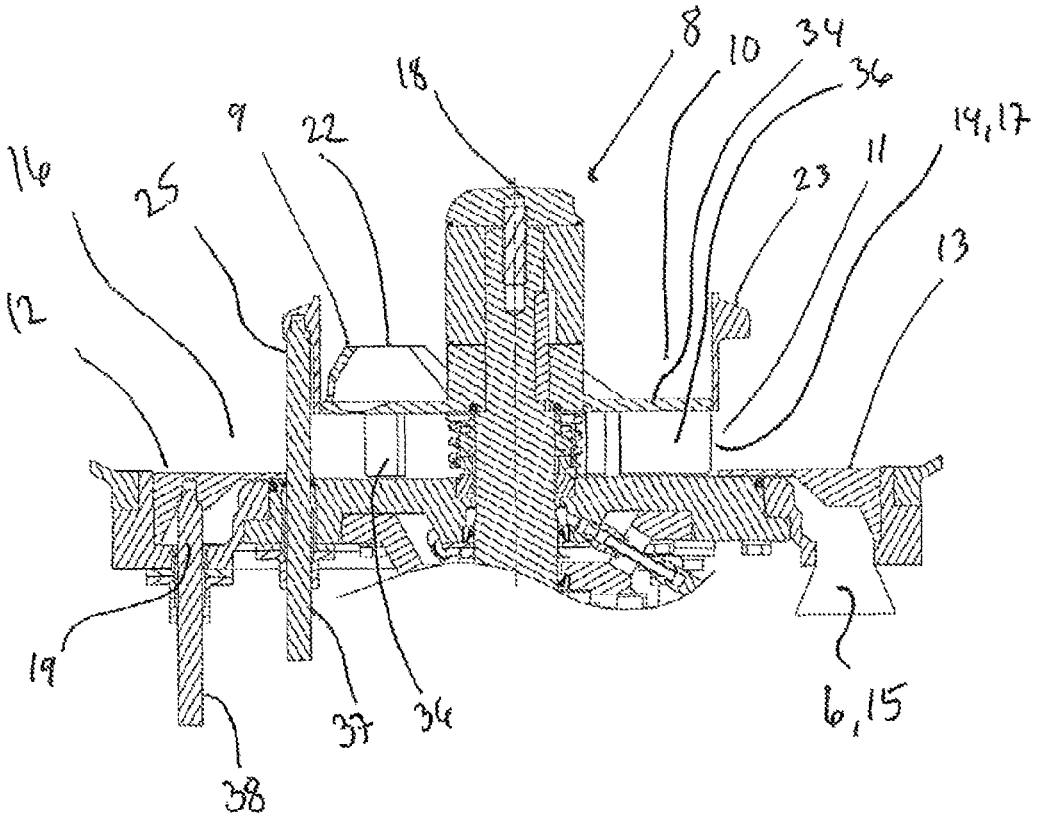
FIG. 14 shows a sectional view of the mixer unit as batch mixer with the perforated ring in its second position.

FIGS. 13-14 show the setting of the mixer unit 8 when it functions as batch mixer with the perforated ring 23 in its second extreme position. The valve body 13 is in its first extreme position such that it shuts off the discharge opening 6 and lets the medium pass directly to the tank 4 in which it is circulated. The medium is not homogenised as it does not pass the perforated ring 23.

Figure 15:
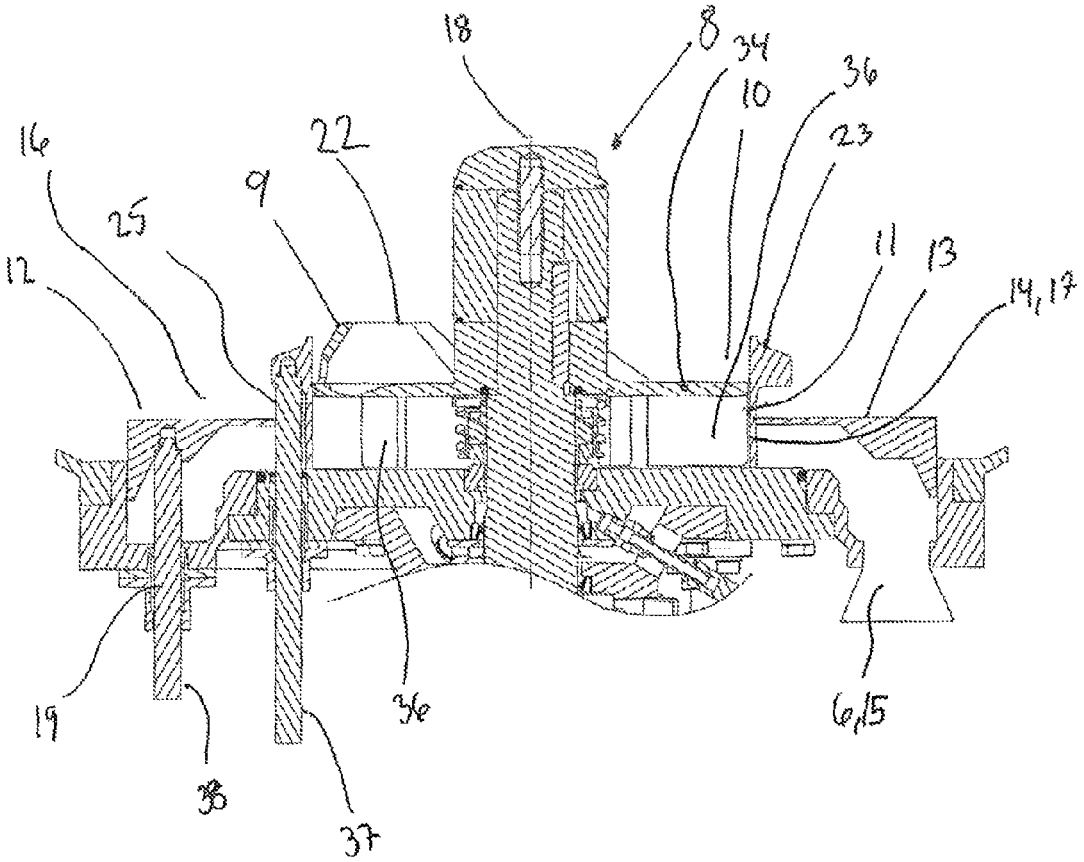
FIG. 15 shows a sectional view of the mixer unit with the valve body in an intermediate position.

FIG. 15 shows the setting of the mixer unit 8 when it functions as a hybrid mixer with the perforated ring 23 in its first extreme position. The valve body 13 is in a position between the two extreme positions so that a part of the medium passes through the discharge opening 6 and another part of the medium passes directly to the tank 4 in which it is circulated. The medium is homogenised as it passes the perforated ring 23.

The hybrid function on FIG. 15 may be provided with the perforated ring 23 in both extreme positions and in an arbitrary position between the two extreme positions.

Figure 16:
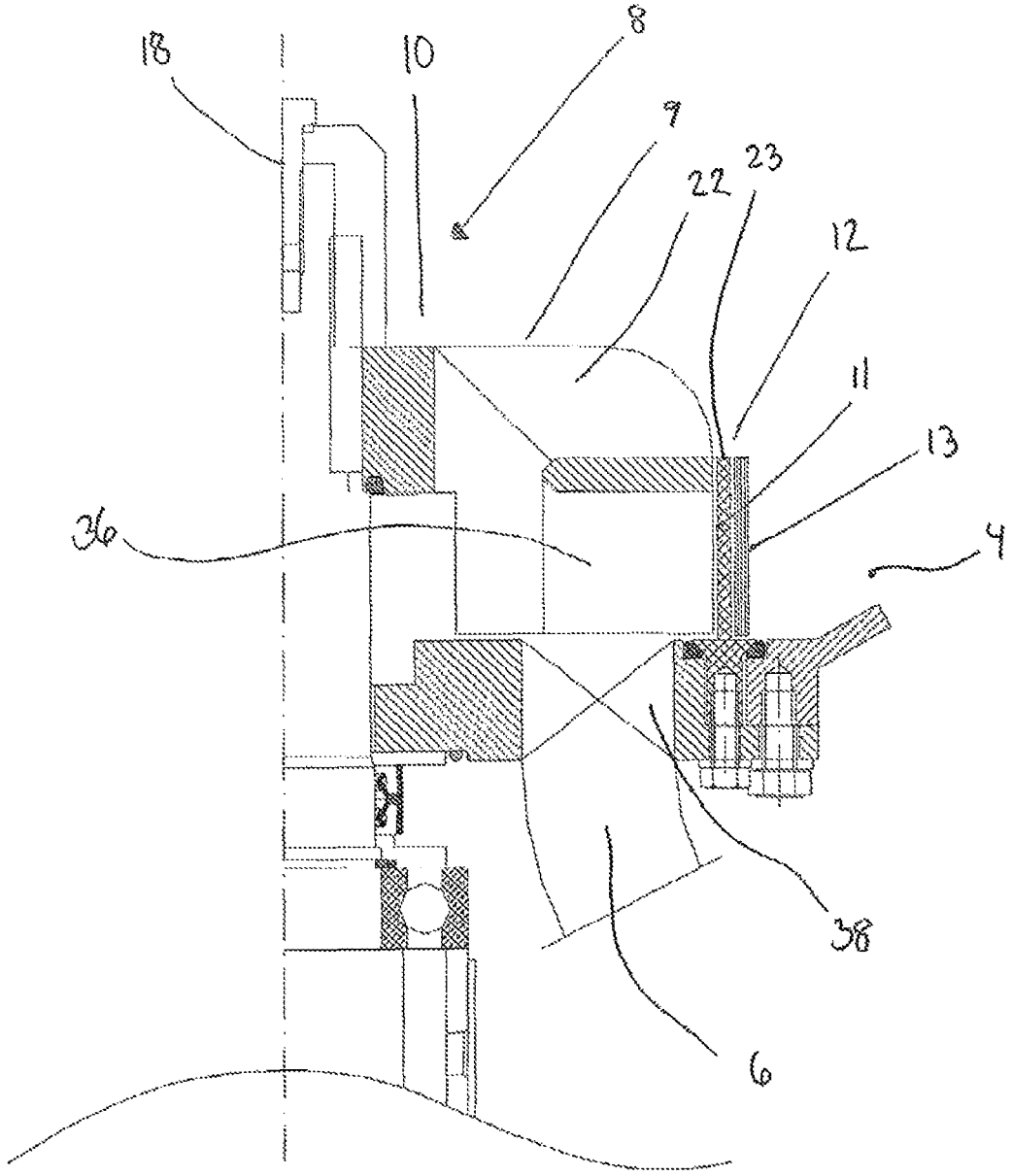
FIG. 16 shows a sectional view of an alternative embodiment of the mixer unit.

FIG. 16 shows the valve arrangement 12 in an alternative embodiment of the invention where the displacement of the valve body 13 is effected by rotation. The mixer unit 8 is shown with a rotor 9 with an inlet 10 and an outlet 11. The rotor 9 rotates about a rotary axis 18, acting with its impeller blades 22, 36 on the medium such that it begins to flow from the rotor inlet 10 towards the rotor outlet 11.

The valve body 13 is made with holes or slots which in number and size correspond to the holes or slots in the perforated ring 23. When the valve body 13 is rotated to its second extreme position, it will block the holes or slots in the perforated ring 23. In this position, a pressure is built up within the perforated ring 23. A valve 38 can be opened in the discharge opening 6 and the medium will flow out of the discharge opening 6. When the valve body 13 is rotated to its first extreme position, the holes or slots in the valve body 13 will fit with the holes or slots in the perforated ring such that the medium can pass to the tank 4 where it is circulated. The valve body 13 can be set in a position between the two extreme positions so that a part of the medium flows out through the discharge opening 6 and another part of the medium is conducted back to the tank 4.

Figure 17:
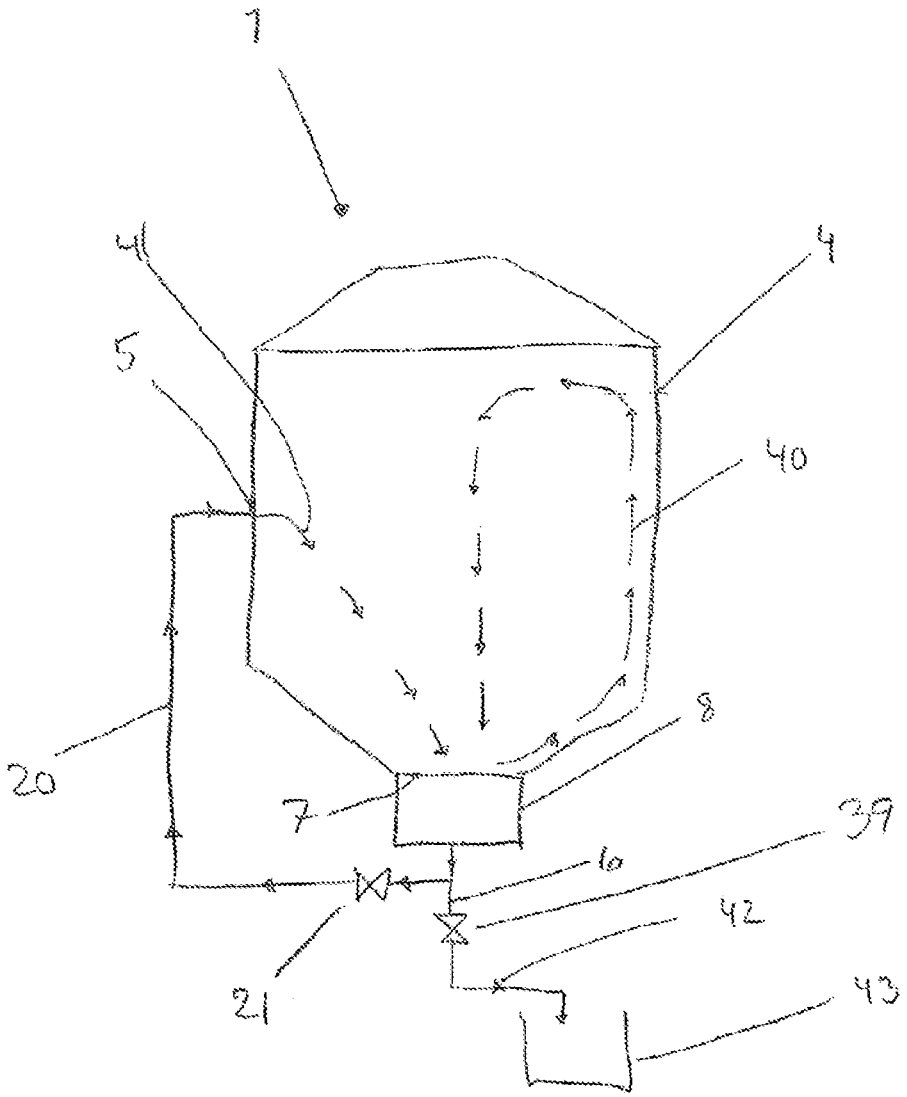
FIG. 17 shows a flow diagram of the mixer.

FIG. 17 shows a flow diagram of the mixer 1. The medium is located in the tank 4. A mixer unit 8 is disposed at the bottom 7 of the tank 4. The tank is provided with a discharge opening 6, a connection 20 between the first outlet 15 of the valve arrangement and a filling opening 5. This connection is provided with a valve 21. The discharge opening of the tank is provided with a shutoff 39. When the medium has reached the desired mixed condition, it is conducted out of the tank 4 and on to further processing, here illustrated by a container 43.

When the mixer 1 operates as batch mixer, the medium will circulate 40 inside the tank 4, and when the mixer 1 operates as inline mixer, the medium will circulate 41 outside the tank. When the tank is emptied, the flow 42 will preferably be out of the tank.

The batch mixer process will typically contain the following steps that presuppose that the mixer 1 is ready and clean, and that all media 2, 3 are ready:

- The valve body 13 is moved to its first extreme position such that the connection to the discharge opening 6 is shut off (see FIGS. 7-8).
- The perforated ring 23 is put in its first extreme position such that it encloses the outlet 11 of the rotor (see FIGS. 7-8).
- The tank 4 is filled with one or more fluid media 2.
- Depending on the need, the media 2, 3 may be heated or cooled before, during or after operation, if the mixer 1 is provided with a device 27, 28, 30 for this purpose.
- The mixer unit 8 is energised, initiating the flow in the tank 4 and mixing and homogenising the media 2, 4.
- Additional solid and fluid media 2, 3 may be added.
- The perforated ring 23 can be moved to its second extreme position such that it does not enclose the outlet 11 of the rotor (see FIGS. 13-14).
- Particles not wanted to be comminuted can be added.
- The valve body 13 is moved to its second extreme position such that the connection 16 to the tank 4 is shut off and the connection to the discharge opening 6 is opened (see FIGS. 11-12).
- When the tank 4 is empty, the mixer unit 8 is switched off.
- The tank 4 is cleaned.

The inline mixer process will typically contain the following steps that similarly presuppose that the mixer 1 is ready and clean, and that all media 2, 3 are ready:

- The valve body 13 is moved to its second extreme position such that the connection to the tank 4 is shut off (see FIGS. 9-10).
- The valve 21 in the connection 20 between the first outlet 15 of the valve arrangement and a filling opening 5 is opened.
- The discharge opening 6 is shut off 39.
- The perforated ring 23 is put in its first extreme position such that it encloses the outlet 11 of the rotor (see FIGS. 9-10).
- The tank 4 is filled with one or more fluid media 2.
- Depending on the need, the media 2, 3 may be heated or cooled before, under or after operation, if the mixer 1 is provided with a device 27, 28, 30 for this purpose.
- The mixer unit 8 is energised, initiating the flow out of the tank through the connection 20 between the first outlet 15 of the valve arrangement and a filling opening 5 and back into the tank 4. During this process, mixing and homogenisation of the media 2, 3 occurs.
- Additional solid and fluid media 2, 3 may be added.
- The perforated ring 23 may be put in its second extreme position such that it does not enclose the outlet 11 of the rotor (see FIGS. 11-12).
- Particles not wanted to be comminuted can be added.
- The valve 21 in the connection 20 between the first outlet 15 of the valve arrangement and a filling opening 5 is closed.
- The shutoff 39 of the discharge opening 6 is removed.
- When the tank 4 is empty, the mixer unit 8 is switched off.
- The tank 4 is cleaned.

With the hybrid mixer function, the inline mixer process will typically contain the following steps that similarly presuppose that the mixer 1 is ready and clean, and that all media 2, 3 are ready:

- The valve body 13 is moved to its second extreme position such that the connection to the tank 4 is shut off (see FIGS. 9-10).
- The valve 21 in the connection 20 between the first outlet 15 of the valve arrangement and a filling opening 5 is opened.
- The discharge opening 6 is shut off 39.
- The perforated ring 23 is put in its first extreme position such that it encloses the outlet 11 of the rotor (see FIGS. 9-10).
- The tank 4 is filled with one or more fluid media 2.
- Depending on the need, the media 2, 3 may be heated or cooled before, under or after operation, if the mixer 1 is provided with a device 27, 28, 30 for this purpose.
- The mixer unit 8 is energised, initiating the flow out of the tank through the connection 20 between the first outlet 15 of the valve arrangement and a filling opening 5 and back into the tank 4. During this process, mixing and homogenisation of the media 2, 3 occurs.
- Additional solid and fluid media 2, 3 may be added.
- The valve body 13 is moved to a position between the two extreme positions (see FIG. 15).
- The valve 21 in the connection 20 between the first outlet 15 of the valve arrangement and a filling opening 5 is closed.
- The shutoff 39 of the discharge opening 6 is removed (see FIG. 17).
- When the tank 4 is empty, the mixer unit 8 is switched off.
- The tank 4 is cleaned.

In the above described example, the hybrid function is used during emptying of the tank 4 such that the medium is constantly moving. This is used typically in connection with media to which a thickening agent is added.

The invention claimed is:

1. A mixer for processing one or more fluid media or one or more solid media, the mixer comprising:

a tank comprising at least one filling opening and a discharge opening;

a mixing unit comprising a rotor, a mixing unit inlet, and a mixing unit outlet; and a valve arrangement comprising:

a valve body having a radial dimension and an axial dimension;

an inlet;

a first outlet; and a second outlet, the valve body being axially movable between a fully closed position and fully open position to allow the flow of media between:

the inlet of the valve arrangement and the mixing unit outlet when the valve body is in the fully closed position and the fully open position;

the first outlet of the valve arrangement and the discharge opening of the tank of the mixer when the valve body is in the fully open position; and the second outlet of the valve arrangement and the mixer tank when the valve body is in the fully closed position, wherein the flow of media is entirely within the tank.

2. The mixer of claim 1, wherein, when the valve body is in the fully open position, the valve body is located a first axial distance from the discharge opening of the mixer, and wherein when the valve body is in the fully closed position, the valve body is located a second axial distance from the discharge opening of the mixer, the second axial distance being less than the first axial distance.

3. The mixer of claim 1, wherein a cross-sectional shape of the valve body is a wedge-shape.

4. The mixer of claim 3, wherein a thickness of the valve body increases in a radially outward direction of the valve body.

5. The mixer of claim 1, wherein the valve body is axially movable to an intermediate position axially between the fully closed position and the fully open position.

6. The mixer of claim 5, wherein when the valve body is in the intermediate position, the first valve outlet is in communication with the discharge opening of the mixer and the second valve outlet is in communication with the mixer tank.

7. The mixer of claim 1, further comprising, a perforated ring including a plurality of passages sized to break up particles of the one or more fluid media or one or more sold media, wherein the valve body is connected to a first actuator and the perforated ring is connected to a second actuator, and the valve body and perforated ring being separately axially movable.

* * * * *